United States Patent [19]

D'Aurora et al.

[11] Patent Number: 4,466,515

[45] Date of Patent: Aug. 21, 1984

[54] INVESTMENT GAME BOARD AND APPARATUS

[76] Inventors: Joseph R. D'Aurora; David F. Specht, both of 5936 Stumph Rd., Apt. 319, Parma, Ohio 44130

[21] Appl. No.: 317,915

[22] Filed: Nov. 3, 1981

[51] Int. Cl.[3] ..... A63F 3/00

[52] U.S. Cl. ..... 273/256; 273/280

[58] Field of Search ..... 273/280, 256; 434/404; 235/78 H, 78 M

[56] References Cited

U.S. PATENT DOCUMENTS

| | | | |
|---|---|---|---|
| 997,986 | 7/1911 | Freeman | 235/78 H |
| 2,673,738 | 3/1954 | Jenkins | 273/256 |
| 2,693,961 | 11/1954 | Ripley, Jr. | 273/256 |
| 2,976,044 | 3/1961 | Corpening | 273/256 |
| 3,058,747 | 10/1962 | Nemetsky et al. | 273/256 |
| 3,539,189 | 11/1970 | Shelton | 273/256 |
| 3,807,739 | 4/1974 | Henley et al. | 273/256 |
| 3,865,380 | 2/1965 | Thomas | 273/256 |
| 3,865,381 | 2/1975 | Hayes | 273/280 X |
| 3,961,795 | 6/1976 | Anspach | 273/256 |
| 4,002,342 | 1/1977 | Biggs | 273/256 |

*Primary Examiner*—Richard C. Pinkham

*Assistant Examiner*—Scott Brown

*Attorney, Agent, or Firm*—Watts, Hoffmann, Fisher & Heinke Co.

[57] ABSTRACT

A stock exchange game is disclosed. A circular playing board is divided into forty spaces at the outer periphery with some spaces representing companies, color coded states of the economy, taxes due, collect dividends, etc. Each company space has a stock price window. There is one state of the economy window. An information board is rotatably mounted under the playing board. The information board has color coded states of the economy and corresponding color coded stock prices. When a state of the economy aligns with the respective window in the playing board, related stock prices align with their respective company windows in the playing board. Players move tokens around the board in response to dice rolls. The state of the economy changes and in turn the stock prices of the companies change when a player lands on an economy condition space. This information board is rotated accordingly and the stock prices change. Stocks are bought and sold during the game. The player with the most money at the end of a predetermined time is the winner.

21 Claims, 12 Drawing Figures

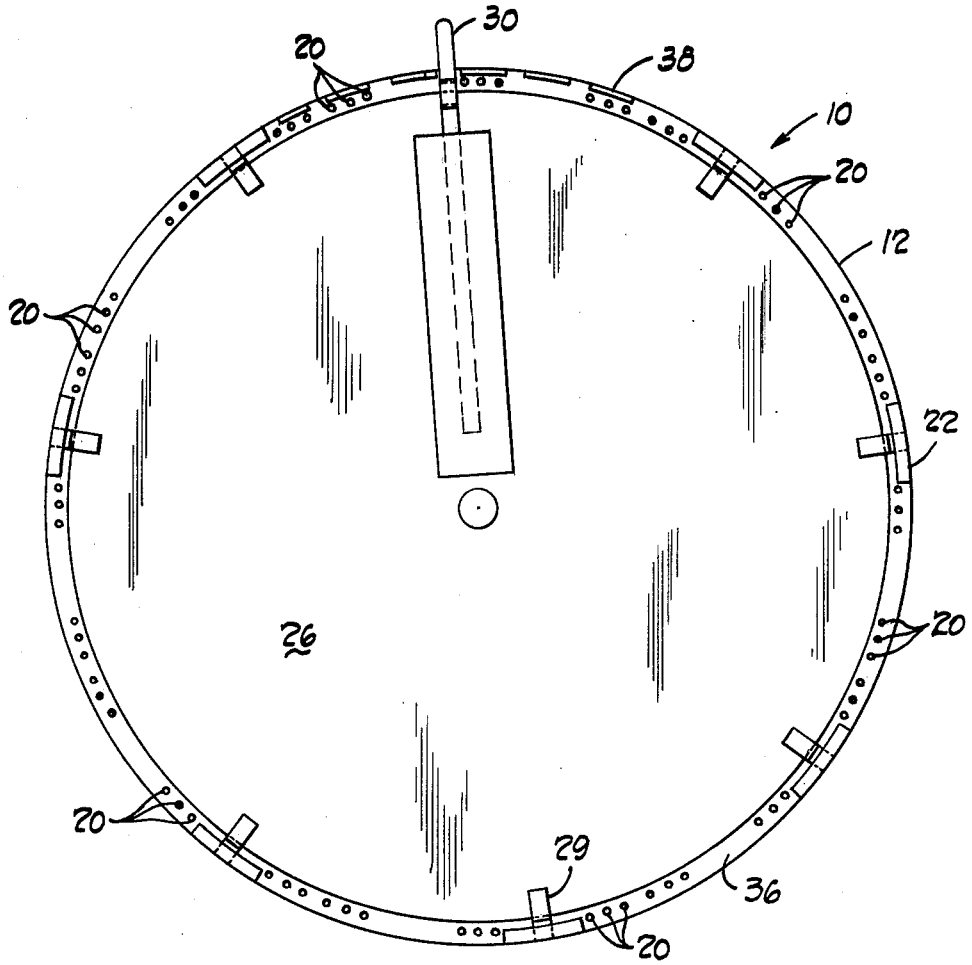
Fig. 3
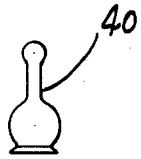
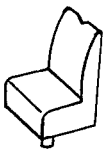
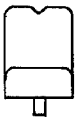
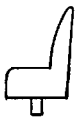
Fig. 5 Fig. 6A Fig. 6B Fig. 6C

| DIVIDEND | | | | |
|---|---|---|---|---|
| DEP. | REC. | NORMAL | INFLATION | SUPER INFLATION |
| 0 - 300 | 0-700 | 0-1500 | 0-3000 | 0-6000 |
| 1 - 600 | 1-1400 | 1-3000 | 1-6000 | 1-12000 |
| 2 - 900 | 2-2100 | 2-4500 | 2-9000 | 2-18000 |
| 3 - 1200 | 3-2800 | 3-6000 | 3-12000 | 3-24000 |
| ⋮ | ⋮ | ⋮ | ⋮ | ⋮ |
| 24-7500 | 24-17500 | 24-37,500 | 24-75000 | 24-150,000 |
| 25-7800 | 25-18200 | 25-39,000 | 25-78000 | 25-156,000 |

INVESTMENT GAME BOARD AND APPARATUS

DESCRIPTION

1. Technical Field

The present invention relates to a board game apparatus and is particularly directed to a game in which dealings on the stock market are simulated.

2. Background Art

Stock market games have been known for many years and have taken a great variety of forms. The various arrangements and designs have as their objective to simulate as closely as possible the circumstances involved in a realistic investment or speculation situation.

Prior art games have not simulated the unpredictability of changing economic conditions in a satisfactory manner. Although business decisions on the market are made with a certain degree of expectation, the economy and in turn the market can fluctuate unpredictably. Such fluctuations affect an investor's gains and losses.

DISCLOSURE OF THE INVENTION

The invention provides a new and novel stock market game and a game board apparatus. The game basically involves the buying and selling of stocks in various companies for the purpose of making a profit while constantly facing the possibility of unpredictable market fluctuations.

The game board apparatus of the present invention is typically placed upon a surface such as a table or the like. The apparatus includes a playing board which has a plurality of playing spaces arranged in a continuous path. The playing board also has apertures for viewing information. An information board is provided which has game indicia arranged to be viewed through the apertures of the playing board. The apparatus also includes a means for indexing the information board relative to the playing board to locate and align the game indicia in a position to be viewed through the apertures. This means also restrains the information board in such an aligned position.

The game, in accordance with the present invention, includes a playing board having a continuous playing path divided into a plurality of spaces. Some of the spaces represent different economic conditions and some of the spaces represent various businesses. A plurality of windows are located in the playing board, each business space having an associated window. One window is provided in the playing board for viewing an economic condition. An information board is movably attached to the playing board. The information board has different economic condition indicia that are viewed through the corresponding window in the playing board.

Groups of differing price indicia representative of the cost of an interest in a business are located on the information board. The prices vary in relation to the economic condition indicia. The price indicia are positioned on the information board to align with a business window in the playing board such that a group of price indicia so aligned corresponds with the economic condition indicium aligned with its corresponding window. The economic condition indicium aligned with its associated window defines a state of the economy.

A random number generating means is provided. A plurality of tokens, one token per player is provided. A player's token is advanced around the path in response to a number from the random number generating means.

The economic condition indicia changes when a token lands on an economic condition space. The price of a business interest varies in relation to the state of the economy. A business interest may be purchased when a token lands on that business space.

Another feature of the invention is the provision for the unpredictable changing of the state of the economy caused by a player landing on an economic condition space.

Still another feature of the present invention is the provision for the collection of dividends by a player when he passes or lands on a dividend space, the amount of the dividend being proportional to the player's number of business interests and the state of the economy at that time.

Still another feature of the present invention is the provision for the payment of taxes, the amount of the taxes varying as a function of the state of the economy at that time.

Yet another feature of the present invention is the provision that a player landing on a buy or sell space forces the player to buy or sell a business interest. Whether or not a player has to buy or sell a business interest and the determination of how many interests must be bought or sold are determined by the roll of the dice. The price of the business interest is determined by the present state of the economy.

Other features and advantages and a fuller understanding of the invention will be had from the following detailed description and the accompanying drawings.

BRIEF DESCRIPTION OF THE DRAWINGS

FIG. 3 is a bottom plan view of the game board of FIG. 1;

FIG. 5 is an elevational view of a playing token employed in the game;

Figure 1:
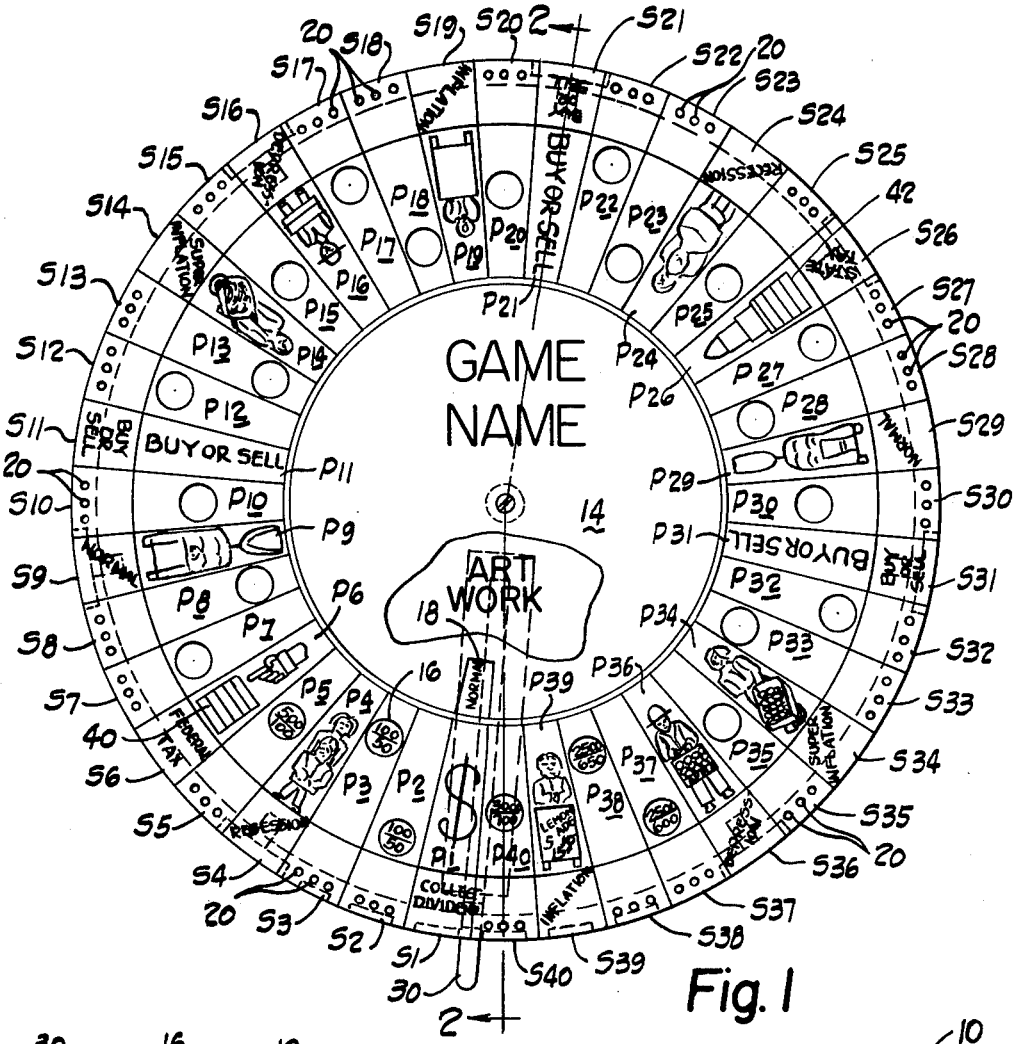
FIG. 1 is a top plan view of a game board employed in playing the game according to the present invention.
Figure 2:
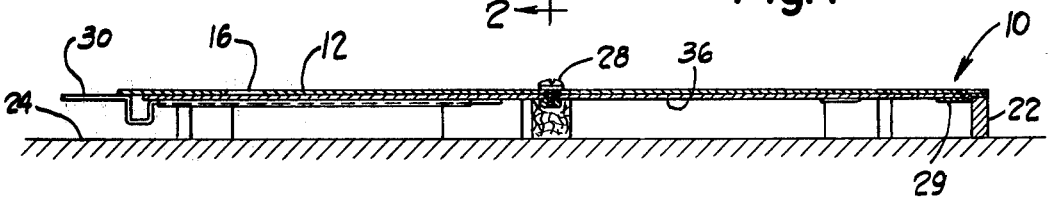
FIG. 2 is a side sectional view taken along line 2—2 in FIG. 1.
Figure 4:
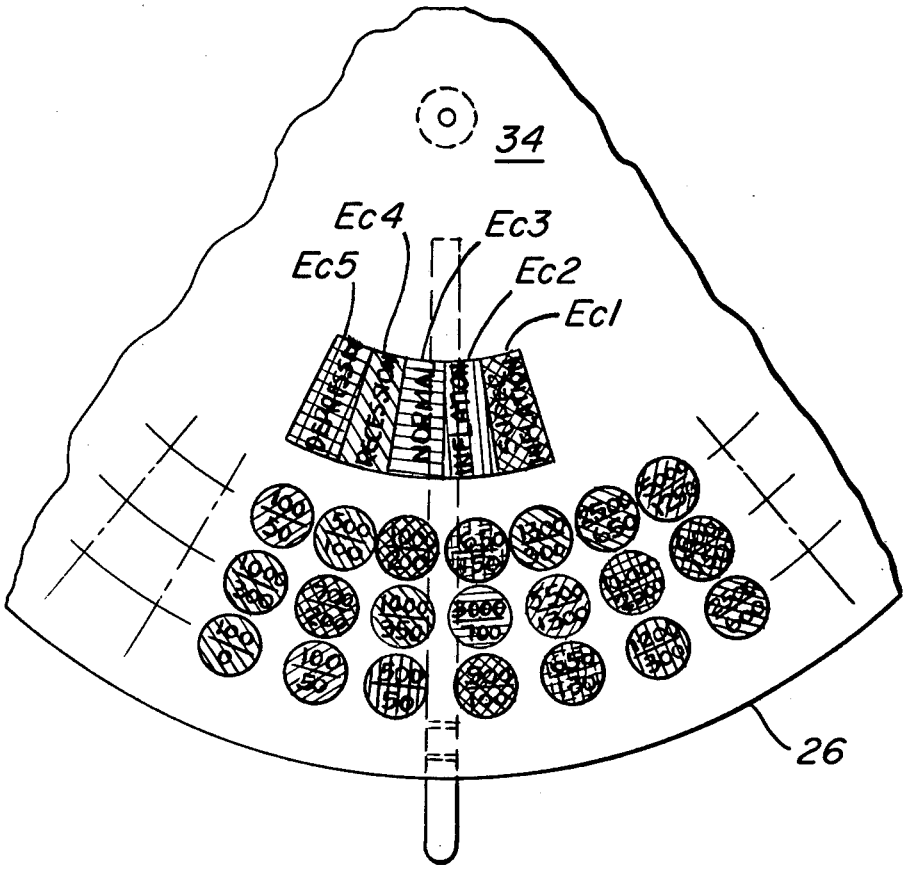
FIG. 4 is an enlarged fragmentary view of the bottom board of FIG. 1.
Figure 7A:
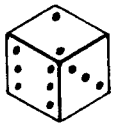
Figure 7B:
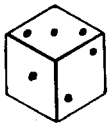
Figures 8, 9:
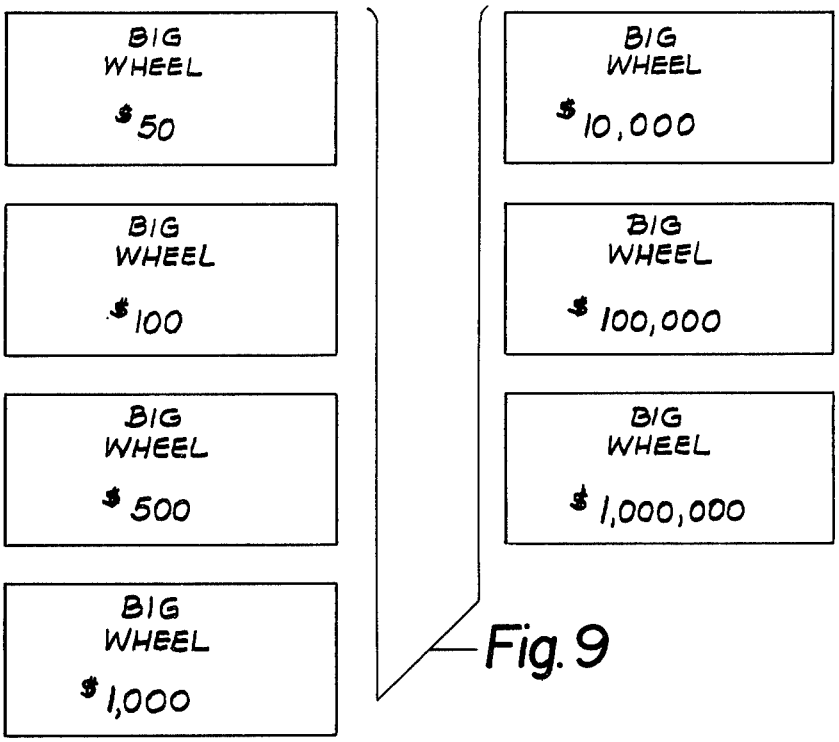

FIGS. *6a–c* are views of a chair used in the game;

FIGS. *7a–b* are perspective views of the dice used in the game;

FIG. 8 is a plan view of a dividend table used in the game;

FIG. 9 is a plan view of the different denominations of play money used in the game.

BEST MODE FOR CARRYING OUT THE INVENTION

Referring now to FIGS. 1–4 there is shown a game board 10 used for playing the game of the present invention. A circular playing board 12 has a playing surface 14, the outer periphery of which is divided into 40 spaces S1–S40. These spaces take the form of a circle. The following are designations for the 40 spaces:

| | | | |
|---|---|---|---|
| S1 | Collect Dividend | S21 | Buy or Sell |
| S2 | Company 1 | S22 | Company 13 |
| S3 | Company 2 | S23 | Company 14 |
| S4 | Recession | S24 | Recession |
| S5 | Company 3 | S25 | Company 15 |
| S6 | Federal Tax | S26 | State Tax |
| S7 | Company 4 | S27 | Company 16 |

-continued

| | | | |
|---|---|---|---|
| S8 | Company 5 | S28 | Company 17 |
| S9 | Normal | S29 | Normal |
| S10 | Company 6 | S30 | Company 18 |
| S11 | Buy or Sell | S31 | Buy or Sell |
| S12 | Company 7 | S32 | Company 19 |
| S13 | Company 8 | S33 | Company 20 |
| S14 | Super Inflation | S34 | Super Inflation |
| S15 | Company 9 | S35 | Company 21 |
| S16 | Depression | S36 | Depression |
| S17 | Company 10 | S37 | Company 22 |
| S18 | Company 11 | S38 | Company 23 |
| S19 | Inflation | S39 | Inflation |
| S20 | Company 12 | S40 | Company 24 |

The spaces S4, S9, S14, S16, S19, S24, S29, S34, S36 and S39 which represent economic conditions or states of the economy, have different color coding which are as follows:

| | | |
|---|---|---|
| S4 | recession | green |
| S9 | normal | blue |
| S14 | super inflation | orange |
| S16 | depression | gold |
| S19 | inflation | pink |
| S24 | recession | green |
| S29 | normal | blue |
| S34 | super inflation | orange |
| S38 | depression | gold |
| S39 | inflation | pink |

Although no specific company or business names have been used for the purpose of this application, company or business names easily recognizable by the general public are preferably used. The direction of play of the game is clockwise with the collect dividend space S1 being the starting position. It is preferable that the companies used in the company spaces be positioned on the playing surface 14 in a clockwise manner according to the economic size of the company starting with the smallest company in the S2 space and the largest in the S40 space.

Adjacent the 40 spaces S1–S40 which are on the outer periphery of the playing surface 14, are 40 corresponding play spaces P1–P40 which define a continuous playing path. As will be appreciated, the game can be played on the spaces S1–S40. However, playing on spaces P1–P40 permits an unobstructed view of the business spaces S1–S40.

Each of the company spaces has one of a set of windows 16 located in the associated play space which is used to view business interest prices for that company. Each of the company spaces also has three receiving holes 20. An economic condition window 18 is also provided for viewing an economic condition which is considered the present state of the economy.

A plurality of support legs 22 are provided to space the playing board 12 above a surface 24 such as a table or the like. An information board 26 is rotatably attached to the playing board 12. The information board 26 is circular in shape and has a diameter less than the diameter of the playing board 12. The information board 26 is positioned between the playing board 12 and the surface 24. An eyelet arrangement 28 rotatably secures the information board 26 to the playing board 12. A plurality of support braces 29 hold the bottom board 26 against the playing board 12. It is preferable that each support leg 22 have an associated support brace 29. The support braces 29 are designed to leave the information board 26 free to rotate with respect to the playing board 12.

A handle 30 is fixed to the information board 26 and extends beyond the outer edge surface 32 of the playing board 12. A player can rotate the information board with respect to the playing board by simply moving the handle 30. It is contemplated that handle 30 will be attached to the information board 26 by means of an adhesive.

The playing surface 34 of the information board 26 has five economic condition indicia EC1–EC5. These economic conditions represent the different states of the economy and are designated as follows:

EC1—Super Inflation
EC2—Inflation
EC3—Normal
EC4—Recession
EC5—Depression These economic condition indicia are located on the surface 34 of the information board 26 such that an economic condition indicium will be visible through the economic condition window 18 of the playing board 12 one at a time. Each of the economic condition indicium EC1–EC5 is color coded to correspond to the color coded economic condition spaces on the playing board 12. For example, the economic condition indicium EC3, which represents a normal state of the economy, is color coded blue to correspond to the blue color coded economic condition spaces on the playing board 12.

The bottom surface 36 of the playing board 12 has a plurality of handle stop locators 38 which index and hold handle 30 in a selected, rotatably fixed position. These handle locators 38 are spaced to allow one economic condition indicium on the information board surface 34 to align with the economic condition window 18 in the playing board 12. The handle 30 has a bend portion 39 located in proximity to the outer periphery of the playing board 12. The bend 39 is designed to position handle 30 between the locators 38 when no force is applied to the handle. The handle 30 is made from a flexible material that will allow the handle to bend slightly to clear the handle locators 38 and allow the information board to be rotated and indexed into a different position. The positions between the locators 38 each corresponds to a different economic condition indicium on the surface 34.

Also located on the surface 34 of the information board 36 are a plurality of stock price indicia. These price indicia are located in three concentric rings about the outer periphery on the information board surface 34 so that they will align with the stock price windows 16 in the playing board 12. The stock price indicia are color coded according to the different states of the economy and are spaced and positioned to be viewed through windows 16 when the corresponding economic condition indicium is in window 18. For example, when the normal economic condition EC3 is positioned to be viewed through the economic condition window 18, blue stock price indicia will appear in the windows 16 at all company positions around the board. The prices of the stock reflect the differing economic conditions, i.e., stock prices during a depression are lower than the stock prices during a recession.

Two numbers appear on each stock price indicium. The radially inner number represents the price at which one would purchase or sell stock and the outer number represents the price for an option to purchase stock. Since the companies are positioned on board 12 in a clockwise direction of increasing economic size, the prices for stock and options for the companies correspondingly increase in a clockwise direction.

The two tax spaces S6 and S26 have five different amounts 40, 42 respectively. The five amounts are color coded to correspond with the five different state of the economies. The amount of the tax due when a player lands on the corresponding play space is therefore dependent on the present state of the economy. The different federal tax amounts and their colors are as follows:

| | | |
|---|---|---|
| Depression | $200.00 | Gold |
| Recession | 500.00 | Green |
| Normal | 1,000.00 | Blue |
| Inflation | 2,000.00 | Pink |
| Super Inflation | 5,000.00 | Orange |

The different state tax amounts and their colors are as follows:

| | | |
|---|---|---|
| Depression | $100.00 | Gold |
| Recession | 200.00 | Green |
| Normal | 500.00 | Blue |
| Inflation | 1,000.00 | Pink |
| Super Inflation | 2,000.00 | Orange |

Referring now to FIG. 5, one token 50 is given to each player. Each of the tokens is of a different color than the others. The tokens are moved along the play path spaces P1–P40 in response to a number generated by a random generating device such as dice shown in FIGS. *7a* and *7b*. The dice are two different colors preferably one white and one red.

Referring now to FIGS. 6A–6C, a player is given 25 chairs to start the game, all chairs being color coded to correspond to the players token. When a player purchases stock in a given company, he is given a chair on the board of directors for that company. In essence, the chair is representative of his interest in that company. When a player purchases stock in a company, he places a base peg of one of his chairs in one of the three chair receiving holes 20. For the purpose of this application, the phrase "purchase of chairs" will be synonomous with the "purchase of stock" for a company. It is possible for only three chairs to be purchased in any one company.

Referring now to FIG. 8, a dividend table is provided which gives the amount of the dividends to be paid to a player when he passes the pay dividend space S1 on the game board 12. The amount of the dividend is dependent upon the economic condition presently viewed through the economic condition window 18 and the total number of chairs a player owns in the various companies.

Referring now to FIG. 9, play money having differing denominations are shown which range from $50.00 up to $1,000,000.00. The amount of money given to each player will be discussed later.

PREPARATION OF THE GAME

The present game is designed to be played by two or more people, although, it is possible for one person to play the game with slightly altered rules. A determination is made as to the time length in which the game will be played. It is preferable that the game be played for at least one hour.

One person is designated as the banker. The banker will also operate the handle 30. The handle 30 is also referred to as the economy mechanism lever. Each player is given $10,000.00 of play money to begin the game in denominations as follows: six $50.00 bills, seven $100.00 bills, eight $500.00 bills, and five $1,000.00 bills. Each player is also given one color coded token and twenty-five chairs of corresponding color coding. To begin the game, each player places his piece on the play space P1 corresponding with the dividend space S1 on game board 12. Each player then rolls the dice and the player with the highest roll goes first. Tokens are moved in a clockwise direction, one space at a time in response to the throw of the dice. Any player throwing a double, gets another turn. The play is in the clockwise direction and thus continues to the player to the left of the player that went first. The game is started with the economy mechanism lever positioned so that the normal economic condition indicium appears in the economic condition window 18.

LANDING ON AN ECONOMIC CONDITION

The state of the economy, which appears through the economic condition window 18 will change each time a player lands on play space corresponding with one of the economic condition spaces on the game board 12. For example, if a player rolls the dice and lands on the play space P14, which corresponds with the super inflation space S14, the economy mechanism lever 30 is rotated until the economic condition super inflation appears in the economic condition window 18. This will alter all of the stock prices appearing in the window 16 for each of the companies. The super inflation condition has the highest prices for stocks and options and the depression economic condition has the lowest prices.

LANDING ON COMPANIES

When a player lands on a play space corresponding to a company space during his turn, he has the choice of whether or not to acquire stock in that company. The purchase of stock in any given company entitles the player to have a chair on the board of directors for that company. If a player chooses not to acquire a chair at that time and if no other player presently owns stock or a chair in that company, the game continues. If the player chooses to buy stock and purchase a chair in that company during his turn, the cost of the stock is the inner dollar amount shown in the stock prices through the corresponding window 16 for that company.

Only one chair may be purchased by a player at a time and only during that player's turn. The money paid for the chair goes to the bank. The player places one of his chairs in one of the three holes 20 for that company. All players in the game will know which players own the chairs in any given company because the chairs are the same color code as the player's token. A maximum of three chairs are available on the board of directors in any particular company. During the course of the game, one player can control all three chairs of one company at the same time. However, the companies may be controlled by a combination of players, each controlling chairs in the same company.

A player can only buy stock and a chair in a company which has an opening, i.e., one in which all three chairs have not already been purchased. Also, a player may not own more than twenty-five chairs total in the various companies since he is given only twenty-five chairs to start the game.

If a player lands on a company space that has one or more chairs owned by other players, he must pay to those other players' option money. The amount of the option money to be paid is the outer dollar amount shown in the stock price window 16 for that company. The option money is paid directly to each player holding a chair. For example, if one player has two chairs, the player landing on that spot must pay the owner of the chairs double the option amount. If three different players have one chair each in a company, each player receives the option money amount.

LANDING ON TAX

When a player lands on a play space corresponding to a tax space, such as space S4 for federal tax or space S26 for state tax, the player must pay to the bank the amount of tax scheduled in that block. As explained above, each of the two tax sections has five different tax amounts which are color coded to correspond to the five economic conditions. The amount of the tax due is a function of the present economic condition. The amount of the tax due is lowest during a depression period and highest during a super inflation period.

The tax to be paid is for each chair a player who lands on the tax space controls. If a player has ten chairs that he controls at the time of landing on a tax space, he must pay ten times the amount shown in the corresponding color coded section in the tax space.

LANDING ON DIVIDENDS

Each time a player passes or lands on the play space corresponding to the dividend space S1, he collects an amount of money from the bank. The amount of money is dependent on the number of chairs he presently has on the game board and the dividend value of those chairs under the present state of the economy. The amount collected is shown in the dividend table of FIG. 8.

If a player passes the dividend space and lands on an economic condition space which changes the state of the economy because of his landing on the economic condition space, the player collects dividends based on the state of the economy that was present at the time he passed the dividend space. For example, if the player passes the dividend space during a normal economy and lands on the play space corresponding to the recession space three spaces later, the game board will change to a recession economy but the player collects dividends based on the normal economy since it was normal when he passed the dividend space.

LANDING ON A BUY OR SELL SPACE

When a player lands on a play space corresponding to a buy or sell space, he must buy or sell his chairs at the then present state of the economy. After landing on this section, he rolls the two different color die. The color of the dice that is the highest determines whether a player buys or sells chairs. If the white dice is higher, he must buy chairs; if the red die is higher, he must sell chairs. If the player rolls a double he must roll the die again in order to make the buy or sell determination. Once it is determined whether the player buys or sells, he then rolls that color die that was higher to determine how many chairs he must buy or sell.

If a player must chooses which company chairs he will sell and then sells those chairs to the bank for the dollar amount shown in the stock price window 16 of that particular company involved. If it is determined that a player must sell a given number of chairs but he does not have that number of chairs on the game board, the player must sell all chairs. The player must then pay to the bank a penalty for each chair that he did not have available for sale. The amount of the penalty that must be paid which is a penalty per chair is as follows:

| | |
|---|---|
| Depression | $50 |
| Recession | $100 |
| Normal | $300 |
| Inflation | $500 |
| Super Inflation | $1,000 |

If a player must buy chairs he chooses in which companies he will buy chairs. The player pays the bank the inner figure in the stock price window 16 for that particular company involved. It will be appreciated that this is the only occasion when a player can buy more than one chair at given time.

A player who must buy chairs can buy one chair from any other player by paying that player the amount of the inner figure. This player would then buy the remainder of his buy order from companies that each have at least one vacancy. If there are no vacant spaces in the companies, the buying player must buy from other players and pay those players the inner figure.

If a player does not have enough money to buy the number of chairs shown on the die, he must sell enough chairs to pay the bank to raise money to buy the number of chairs shown on the die. In this case, the player is restricted from buying back a chair in any of the companies that he just sold chairs in order to obtain finances.

SELLING CHAIRS

Chairs can be sold, other than as specified above, only to the bank. Players can voluntarily sell chairs in order to take advantage of an economic condition, to raise money, in order not to be taxed, etc. The voluntary selling chairs can only be done only during a player's turn and before the player rolls the dice. If a player lands on a section that makes him pay an amount of money that he does not have he must sell his chairs to the bank to get enough money to pay his debt. He must sell only that number of chairs that will allow him to cover the debt. He may sell any chairs he chooses but when enough money is received from the bank to pay the debt, no more chairs can be sold. Chairs are sold to the bank at the current inner figure shown in the stock window 16.

BANKRUPTCY

Any time a player cannot pay a debt, even after selling all his chairs to the bank, he is bankrupt and out of the game. Also, if a player lands on a section which requires an action be taken, such as a buy or sell, and that player does not have enough money or cannot raise enough money by selling his chairs, he is also bankrupt and out of the game. When bankruptcy occurs and the player owes the bank money, the bankrupt player sells his chairs on the board to the bank and pays the bank what he has from the sale. If the bankrupt player owes another player or players, he sells the chairs he has on the board to the bank and pays the player what he has or pays the players what he has in equal amounts.

END OF THE GAME

When the predetermined time has expired, the game is over after all players complete their turn. At this time, the players remaining between the present dice roller and the player who started the game will be allowed one more than so that all the players have an equal number of turns. Those players who roll doubles will still have an extra roll of the dice.

After all turns are completed, all players must sell their chairs that are in play on the game board back to the bank at the prices shown in the stock windows 16. All players add up their money and the player with the most money is the winner.

PLAY BY ONE PLAYER

The game may be played by one player. In such a condition, option money is not paid or received. The player tries to make as much money as he can within the time period he selects. The below table represents the total of the players money at the end of the game and reflects a standard of a players ability. These averages are based on a one hour game.

| | |
|---|---|
| 0–$50,000.00 | Needs more practice |
| $50,000–$100,000 | Improving |
| $100,000–$150,000 | Not bad |
| $150,000–$200,000 | Impressive |
| $200,000 and up | Winner |

Other modifications and variations of the invention will be apparent to those skilled in the art in view of the foregoing detailed disclosure. Therefore, it is to be understood that, within the scope of the appended claims, the invention can be practiced otherwise than as specifically shown and described.

We claim:

1. A business game comprising:

a playing board having a playing path divided into a plurality of spaces, some spaces representing businesses each different than the other businesses and other spaces each permanently representing one of a plurality of different states of the economy, at least one pair of economy representing spaces being spaced and for the same state of the economy;

playing pieces, one for each player and each for movement along the path a distance determined by a random number generator operated during a turn of a player having that playing piece;

economic condition indicating means for selectively indicating an appropriate one of the plurality of states of the economy when moved to respond to a change in game conditions dictated by a playing piece landing on one of the state of the economy spaces;

price indicating means for providing purchase prices for interests in each of the businesses, said purchase prices being related to said selected state of the economy.

2. The business game of claim 1 further including devices each for indicating a purchased interest in a business space.

3. The business game of claim 2 wherein each of said devices is a chair which is placed on a business space when an interest is purchased said chair representing a chair on the board of directors for that company.

4. The business game of claim 1 wherein the economic and price indicating means are each provided by an information board movably secured with respect to said playing board, said information board containing game indicia including state of the economy indicia and purchase price indicia.

5. The business game of claim 4 wherein said playing board has a plurality of apertures for viewing said game indicia and wherein said means for indicating a present state of the economy is said state of the economy indicia viewed through one of said apertures and wherein said means for indicating a purchase price being said purchase price indicia viewed through certain of said apertures.

6. The business game of claim 1 wherein purchased interest indicating devices are provided for positioning in association with selected business spaces to indicate when a player landing on a business space in which another player owns an interest, must pay said another player an amount of money indicated by a corresponding option price.

7. The business game of claim 1 further including a dividend space as one of the spaces of said playing path, to indicate that a player passing or landing on the dividend space will collect dividends proportional to the then selected state of the economy and the number of interests he owns at the time he passes said dividend space.

8. The business game of claim 1 further comprising tax spaces having coded tax amounts to correspond to the different states of the economy so that when a player lands on a tax space players are able to determine the related tax amount for each of the number of business interests that the landing player owns.

9. A business game comprising:

a playing board having a playing path divided into a plurality of spaces, some of the spaces each permanently representing one of a plurality of different economic conditions and other of the spaces each representing a different business, the economic condition spaces including spaced pairs of like condition indicators;

a plurality of windows in said playing board, each business space having an associated window;

one window in said playing board being for viewing an economic condition;

an information board movable mounted with respect to said playing board, said information board having a plurality of differing economic condition indicia that are viewable one at a time through said one window in said playing board, the information board also having groups of differing price indicia each representative of a different cost of an interest in a business, the costs having values related to the economic condition indicia, said price indicia being positioned on said information board to align selectively with corresponding business windows in said playing board such that a group of price indicia so aligned corresponds with the economic condition indicia aligned with said one window, the economic condition indicia aligned defining a state of the economy;

random number generating means;

a plurality of tokens, one token per player, a player's token being sequentially advanced around said path in response to numbers from said random number generating means;

said state of the economy for all players being changed to a new condition when a token lands on an economic condition space different than the condition then existing, the price of a business interest being changed in relation to a change in said state of economy; and, the landing of a token on a business interest space providing an indication that an interest in that business, if available, may then be purchased.

10. A business game comprising:

a playing board having a playing path divided into a plurality of spaces, some of the spaces each representing a different business, each business having a predetermined number of interests for sale, and other of the spaces representing different economic conditions, certain of the different economic condition spaces being coded differently than others;

said playing board having a plurality of price windows, each business space having an associated window for the purpose of viewing prices of interests in that business;

said playing board having an economic condition window for viewing an economic condition;

an information board movably mounted with respect to said playing board;

said information board having a plurality of price indicia divided into groups, each of the groups corresponding to a different one of the economic condition spaces on the playing board, the prices of a group being related to a corresponding economic condition;

said information board also having economic condition indicia each corresponding to an associated one of the states of the economy and coded to correspond to its economic condition space on said playing board;

said price indicia and said economic condition indicia being positioned on said information board to permit selective viewing through said price windows and said economic condition window respectively, one group of price indicia and one economic condition indicia being viewable at a time to provide a set of values corresponding to a state of the economy;

means for moving said information board with respect to said playing board;

random number generating means;

a plurality of tokens, one token per player, a player's token being sequentially advanced along said playing path in response to numbers from said random number generating means;

said state of the economy being changed for all players when a token lands on an economic condition space representing a condition different than the condition then existing to establish prices for business interests relating to the associated state of the economy;

a plurality of groups of board mountable devices coded differently from one another, one group of devices per player, a player's purchased interests in a business being indicated by the placing of that players device on that business space; and, the board being constructed to accept a plurality of said coded devices along the periphery of said business spaces, and the board and the devices being constructed such that together they delineate the total number of business interests which may be purchased in a given business.

11. The business game of claim 10 wherein each price indicia for a given business includes two prices, a first representing the price of an interest in a business and a second representing the price of an option in that business.

12. The game of claim 10 wherein the devices are configured as chairs.

13. The game of claim 10, wherein the chairs include projections adapted to be received in game board receiving holes.

14. An investment game comprising:

(a) a playing board including a player token advancement path divided into a plurality of spaces;

(b) an information board including indicia and being movably connected to the playing board;

(c) player tokens each of which has a different visual appearance than the other tokens;

(d) certain of the playing board spaces being a business set representative of businesses in which players may invest, at least some of the spaces in the business set being apertured;

(e) certain other of the spaces forming an economic condition set each representative of an economic condition different than at least some of the conditions of the remaining spaces of the set;

(f) indexing means for relatively moving the boards to align selected and appropriate indicia which apertures of the business set spaces whenever a player's token lands on one such economic condition space of an economic condition different than that then prevailing, such relative movement resulting in a change of economic condition for the entire board and all players;

(g) a random number generating means for determining the number of spaces each player's token will be advanced each player turn;

(h) a plurality of groups of board mountable devices coded differently from one another, one group of devices per player, a player's purchased interest in a business being indicated by the placing of that players device on that business space; and, the board being constructed to accept a plurality of said coded devices along the periphery of said business spaces (i) the board and the devices being constructed such that together they delineate the total number of business interest which may be purchased in a given business.

15. The game of claim 1 wherein still other spaces provide a money transfer set each determining a flow of money to or from a player when that player's token lands on a space of the set.

16. The game of claim 15 wherein at least some of the spaces of the money transfer set are tax paying spaces whereby a player pays taxes whenever his token lands on one of them.

17. The game of claim 15 wherein one of the spaces is a buy-sell space whereby a player either buys or sells interests in the businesses of the business set whenever that player's token lands on the buy-sell space.

18. The game of claim 15 wherein one of the spaces is a dividend space whereby a player receives monies representative of his investments in the business set whenever that player's token lands on the dividend spaces.

19. The game of claim 14 wherein the devices are configured as chairs.

20. The game of claim 19 wherein the chairs include projections adapted to be received in game board receiving holes.

21. The game of claim 14 wherein the spaces representing different economic conditions include spaced pairs of like spaces.

* * * * *

UNITED STATES PATENT AND TRADEMARK OFFICE

CERTIFICATE OF CORRECTION

PATENT NO. : 4,466,515

DATED : August 21, 1984

INVENTOR(S) : Joseph R. D'Aurora et al.

It is certified that error appears in the above-identified patent and that said Letters Patent is hereby corrected as shown below:

Column 7, line 60, "die" should read -- dice --.

line 65, after "must" insert -- sell, he --.

Column 8, line 42, after "selling" insert -- of --.

Column 9, line 5, "than" should read -- turn --.

Claim 14, paragraph f, second line, after "indicia" "which" should read -- with --.

Signed and Sealed this

*Twenty-sixth* Day of *February 1985*

[SEAL]

*Attest:*

DONALD J. QUIGG

*Attesting Officer* *Acting Commissioner of Patents and Trademarks*